US006640397B1

(12) United States Patent
Gipson

(10) Patent No.: US 6,640,397 B1
(45) Date of Patent: Nov. 4, 2003

(54) QUICK RELEASE HARNESS DEVICE

(76) Inventor: Dale Gipson, 5216 - 240th Ave. NE., Redmond, WA (US) 98053

( * ) Notice: Subject to any disclaimer, the term of this patent is extended or adjusted under 35 U.S.C. 154(b) by 0 days.

(21) Appl. No.: 10/177,199

(22) Filed: Jun. 20, 2002

(51) Int. Cl.[7] ..... A44B 21/00; A44B 11/00
(52) U.S. Cl. ..... 24/191; 24/68 T; 114/39.18
(58) Field of Search ..... 24/191, 192, 170, 24/318, 343, 573.11, 68 E, 68 T, 69 R, 68 R, 68 CD, 70 ST; 114/39.16, 39.18; 292/247, 113; 244/155 R, 155 A

(56) References Cited

U.S. PATENT DOCUMENTS

| | | | | | |
|---|---|---|---|---|---|
| 2,430,985 | A | | 11/1947 | King | 24/573.11 |
| 2,945,274 | A | * | 7/1960 | Paterson | 24/68 T |
| 3,034,596 | A | | 5/1962 | Twaits, Jr. | 182/3 |
| 3,083,426 | A | * | 4/1963 | Neilson | 24/68 T |
| 3,670,371 | A | * | 6/1972 | Swanson | 24/68 T |
| 4,112,865 | A | | 9/1978 | Carn | 114/270 |
| 4,452,161 | A | | 6/1984 | McCoy | 114/39 |
| 4,630,563 | A | | 12/1986 | Pertramer | 114/39 |
| 4,873,934 | A | | 10/1989 | Renault | 114/39.2 |
| 5,002,002 | A | * | 3/1991 | Awalt, Jr. | 114/210 |
| 5,271,649 | A | * | 12/1993 | Gromotka | 292/113 |
| 6,293,215 | B1 | * | 9/2001 | Moorrees | 114/39.18 |

* cited by examiner

*Primary Examiner*—Robert J. Sandy
(74) *Attorney, Agent, or Firm*—Dean A. Craine

(57) ABSTRACT

A quick release harness system for wind or kite surfers or the like that enables users to manually release themselves from the harness line during a "blow over" event and which can easily reconnect to the harness line when desired. The system includes a quick release, biased lever mounted to a main bracket. The main bracket is attached to a waist support member worn around the waist of the user. Located below the lever and attached to the main bracket is a biased pivoting hook member with a forward extended arcuate section designed to engage a ring or similar structure attached to the distal end of a harness line. Also attached to the main bracket is a biased pivotal latch that selectively moves between engaged and disengaged positions with the hook member. Movement of the latch is manually controlled by pressing downward on the lever which enables the latch to rotate inward and move to a non-blocking position so that the hook member is able to move upward and disengage from the harness line. The lever and the hook member are both biased so that they automatically return to their original positions for re-engagement to the harness line. The latch is also biased so it automatically returns to a locked position.

1 Claim, 9 Drawing Sheets

QUICK RELEASE HARNESS DEVICE

BACKGROUND OF THE INVENTION

1. Field of the Invention

This invention pertains to a harness device used by wind and kite surfers, and more particularly, to harness devices that include quick release features that enable a user to quickly engage and disengage a harness device from a harness line.

2. Description of the Related Art

Both wind and kite surfers use floatable boards with foot straps mounted on the board into which the users place their feet. With windsurf boards, a fin is attached to the bottom of the board, a mast is pivotally attached to the board via a universal joint, a u-shaped boom is attached at its opposite ends to the mast that extends to the starboard and port sides of the board, and a sail is attached to the mast. Kite surfers grab onto a pair of bridle lines that are connected at their upper ends to the edges of a kite flown by the user and connected at their lower ends to a lightweight handle bar.

In both sports, users often wear a harness worn around their waist or upper torso. Attached to the front, middle axis of the harness is a hook member that selectively engages a harness line attached to the boom or to the handle bar.

During use, the windsurfers launch the board into the water and simultaneously hold the sail upright into the wind. Once they are upright and underway, they step into the foot straps. Once properly positioned on the board, the user engages the harness line into a hook member attached to a harness. Kite surfers typically follow the same procedures, with the exception of connecting the hook members to the harness line before lifting the kite into the wind.

When wind or kite surfing, users must continuously adjust their position on the board to counteract the wind forces exerted on the sail or kite. Not only do users need to move quickly back and forth between the starboard and port sides of the board, but they must move quickly between fully standing and crouching positions. They also must lean inwards or outwards.

A "blow over" is a common accident that occurs when a sudden gust of wind fills the sail or kite, which immediately pulls the user over the board and slams him or her into the water. When these accidents occur while wind surfing, the user may be thrown into the boom, causing injury or damage to the boom and sail. When these accidents occur while kite surfing, the kite may continue to fly, pulling the user across the water in a downward facing position and potentially causing him or her to drown.

As mentioned above, in both sports, a harness line is normally attached to a hook member on the harness worn by the user. One drawback with standard harness lines and hook members is that they cannot be quickly disengaged during a blow over. U.S. Pat. No. 4,112,865 discloses a harness system for sailboard operators that uses a quick release hook member that releases the hook from the harness line by laterally pulling a cord attached to the hook. Unfortunately, blow overs happen so quickly and unexpectedly that most riders don't have sufficient time to pull a cord laterally.

What is needed is an improved quick release harness device for windsurfers and kite surfers that enable the user to quickly and easily disconnect from the harness line.

SUMMARY OF THE INVENTION

It is an object of the present invention to provide an improved quick release harness device for wind or kite surfers.

It is another object of the present invention to provide such a harness device that selectively connects to a harness line used during wind or kite surfing.

It is a further object of the present invention to provide such a harness device that can be quickly and conveniently manually disconnected from the harness by the user while riding.

It is a still further object of the present invention to provide such a harness device that automatically resets itself after being disconnected.

These and other objects of the invention which will become apparent are met by a quick release harness device for a wind or kite surfer or the like that enables the surfer to immediately release himself from the harness line during a blow over event and then quickly and easily reconnect himself to the harness line when desired. The device includes a main bracket attached to a waist support member worn around the user's waist. The waist support member may be a separate component or a component integrally formed into a belt or harness. Attached to the main bracket and below the lever is a pivoting hook member with a forward extended arcuate section designed to partially wrap around a ring or similar structure attached to the distal end of a harness line when it is in a locked position. Located on the opposite end of the hook member is a straight and rearward extended section. Attached to the main bracket, medially with respect to the hook member, is an upward extending latch. The latch includes a hook member support surface that supports the proximal end of the rearward extending section on the hook member when the hook member is in a locked position where pivotal movement of the hook member is prohibited. During operation, the lever is pressed downward which automatically allows the latch to pivot rearward thereby disengaging from the proximal end of the hook member. When the latch moves to a disengaged position, the tension force exerted by the harness line on the hook member automatically causes the hook member to rotate in a counterclockwise direction and release the harness line.

The first embodiment is designed to be used by windsurfers where movement of the latch between engaged and disengaged positions is manually controlled by pressing downward on the lever. A first biasing means disposed between the lever and the main bracket automatically returns and maintains the lever to an upper extended position when the pressure is removed. A second biasing means is provided between the latch and the main bracket to keep the latch in an engaged position with the hook member. A third biasing means is provided between the hook member and the main bracket to keep the hook member in its original locked position.

In a second embodiment designed to be used by kite surfers, movement of the latch between the engaged and disengaged positions is also manually controlled by pressing downward on the lever which disengages it from the main bracket so that it is able to pivot rearward. The latch includes an upper portion that extends upward under the lever and above the hook member. When the user presses the lever downward and then pulls the lever rearward, the latch member automatically pivots rearward thereby disengaging from the hook member. A first biasing means is disposed between the lever and the upper portion of the latch member to maintain the lever in a locked position on the main bracket. A second biasing means is disposed between the latch and main bracket to keep the latch in an engaged position.

DESCRIPTION OF THE PREFERRED EMBODIMENT(S)

Figure 1:
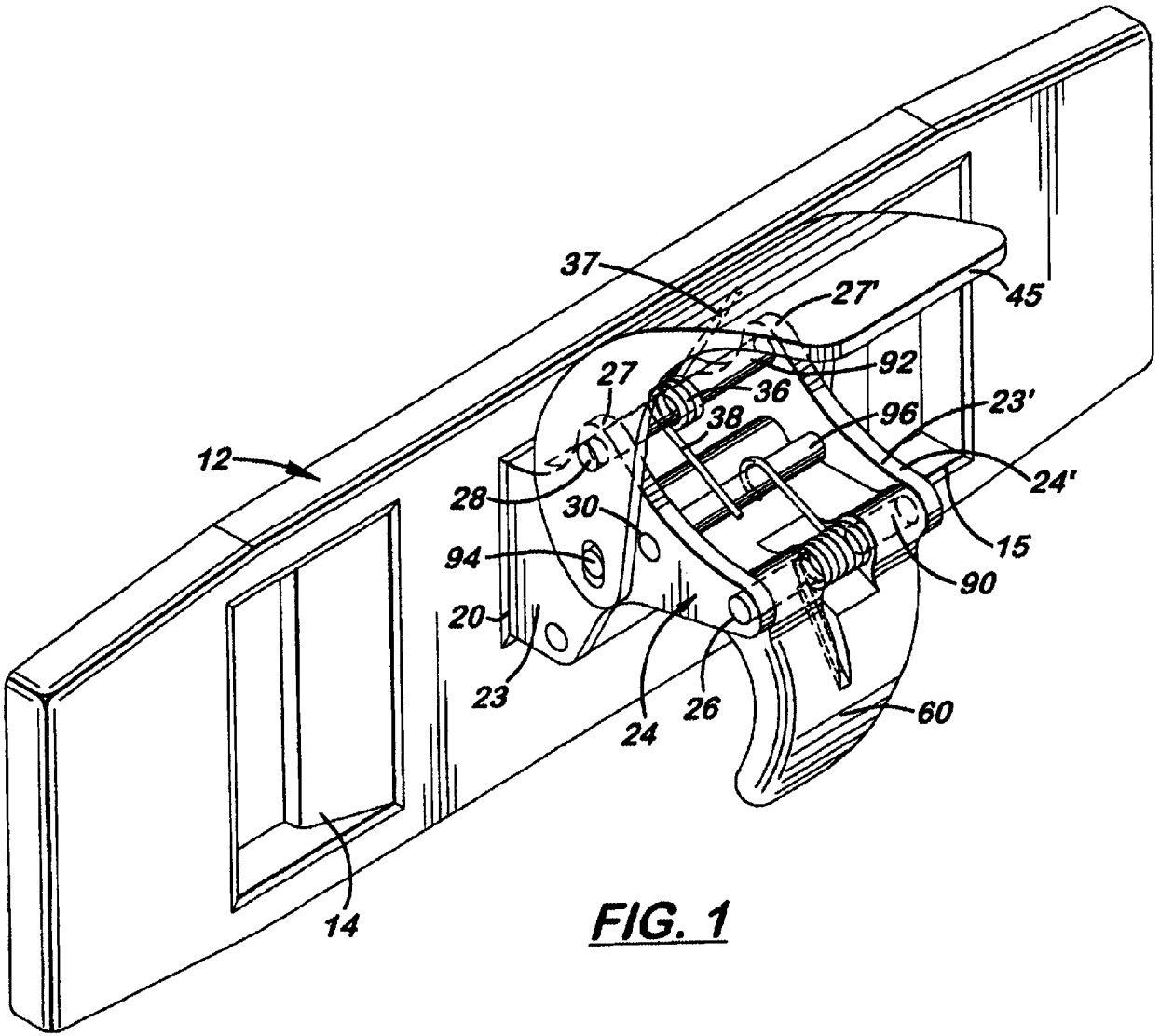
FIG. 1 is a perspective view of the quick release harness device used by windsurfers.

Referring to the accompanying Figs., there is shown and described a quick release harness system 10 for a sailboard or kite board user or the like that enables the user to immediately release themselves from the harness line 98 during a blow over event and then quickly and easily reconnect themselves to the harness line 98 when desired.

The system 10 includes a quick release lever 45 mounted at one end to a main bracket 20 which is attached to a waist support member 12 worn around the user's waist. The waist support member 12 may be a separate component or integrally formed into a belt or harness worn by the user. The main bracket 20 is centrally attached to the waist support member 12. Attached to the main bracket 20 and below the lever 45 is a pivoting hook member 60 with a forward extended, downward curved, arcuate section 65 designed to engage a ring 11 or similar structure attached to the distal end of a harness line 98. As shown more clearly in FIG. 2, formed on the opposite, proximal end 72 of the hook member 60 is a straight, rearward extended section 70. Also, attached to the main bracket 20 medially with respect to the hook member 60 is an upward extending latch 80. During normal operation, the distal end 82 of the latch 80 supports the proximal end 72 of the hook member 60 when the hook member 60 is engaged on the ring 11. The latch 80 is designed to selectively move inside curved slots 29, 29' formed on the two side members 23, 23', respectively, on the main bracket 20. During use, the latch distal end 82 pivots between a supporting and non-supporting disengaged position with the proximal end 72 of the hook member 60. When the distal end 82 of the latch 80 is in a supporting position, the hook member 60 is locked so that pivotal movement is prohibited. When the distal end 82 is in a non-supporting position, the hook member 60 is unlocked and pivotal movement of the hook member 60 is permitted.

The waist support member 12 is a slightly curved, rectangular shaped structure designed to conform to the user's lower abdomen. Formed on the opposite ends of the waist support member 12 are two belt receiving slots 14, 15 which connect to a belt (not shown) or a harness (not shown) worn by the user.

Figure 2:
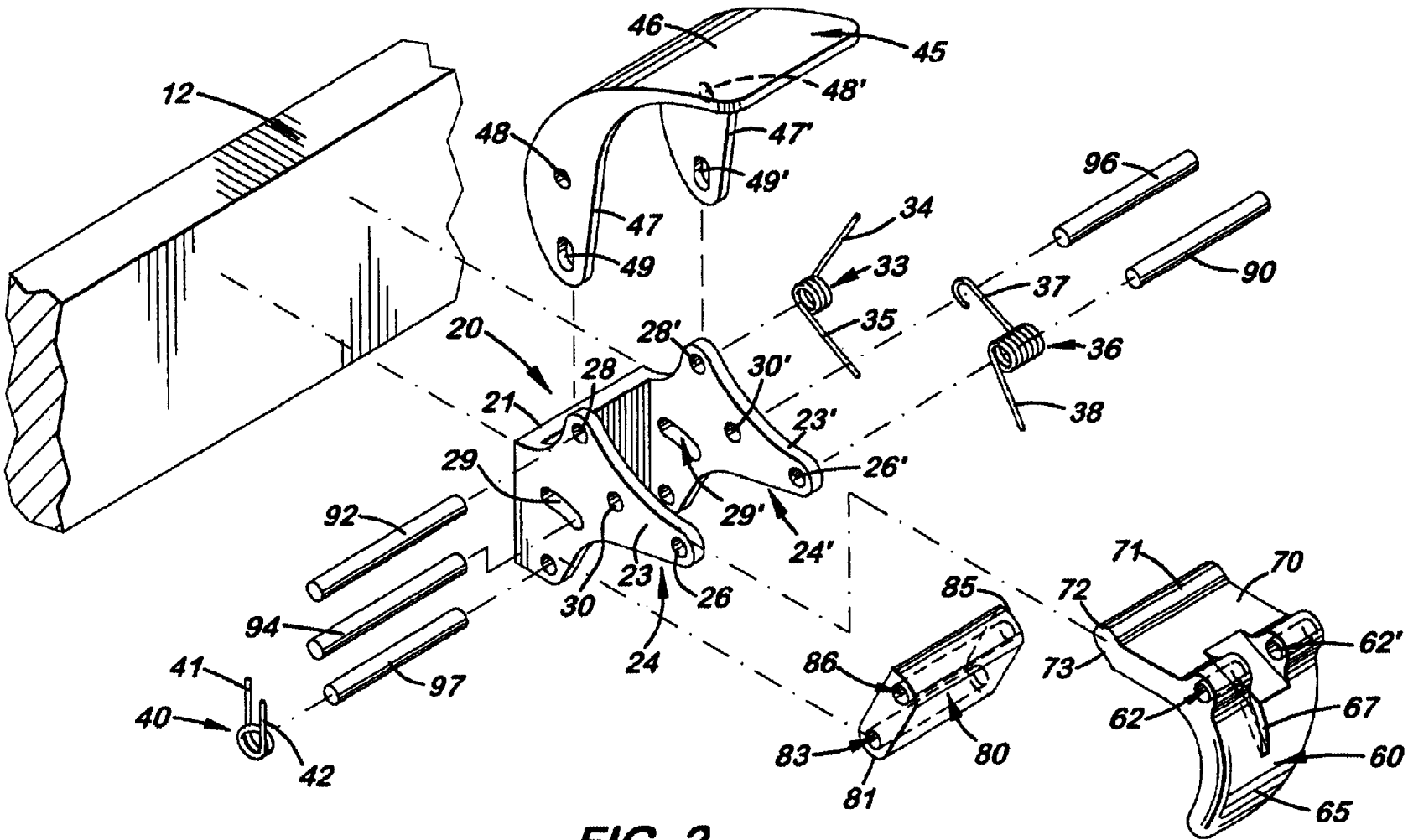
FIG. 2 is an exploded, perspective view of the invention.
Figure 3:
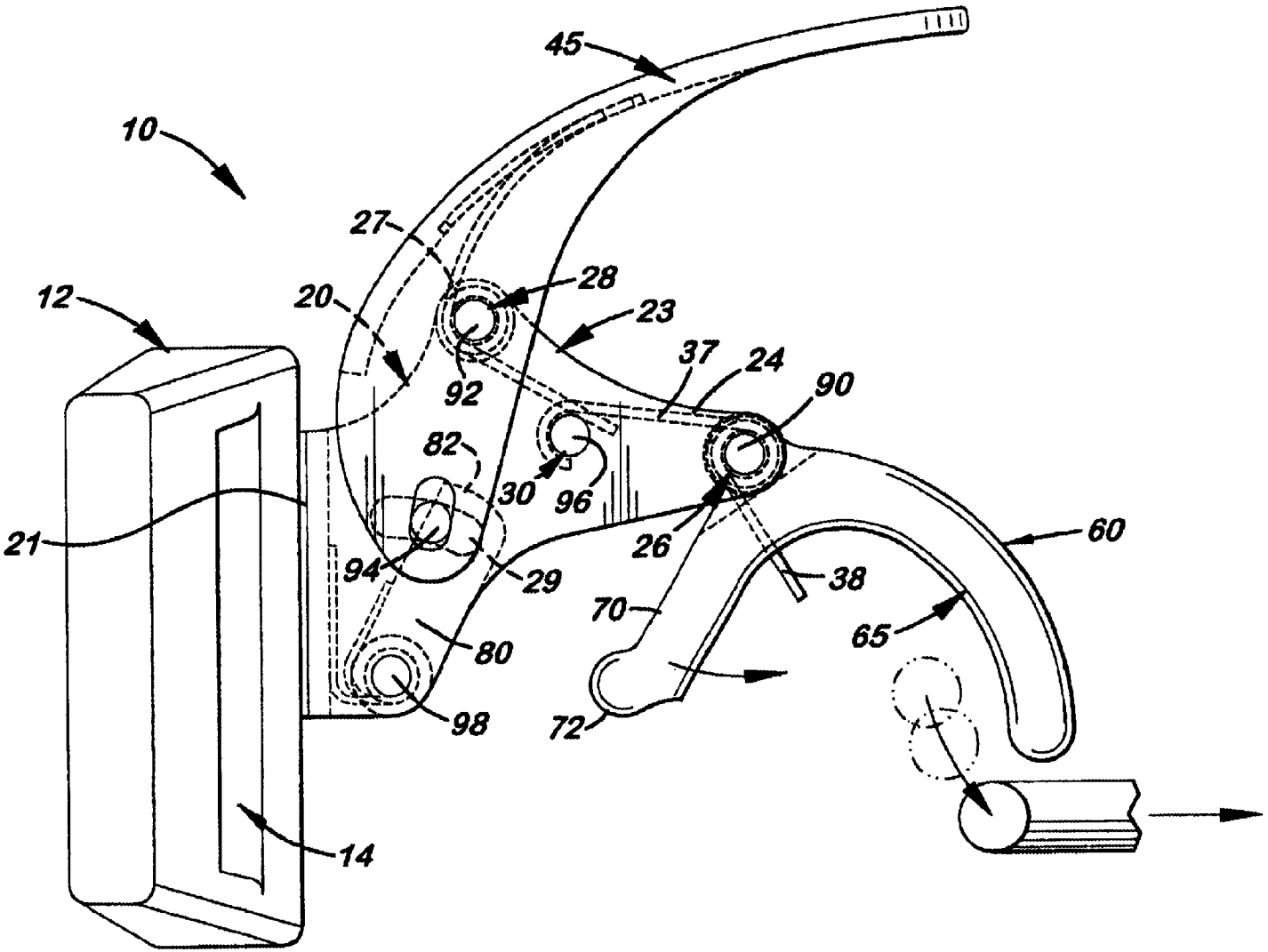
FIG. 3 is a side elevation view of the invention.

As shown more clearly in FIGS. 1–3, the main bracket 20 includes a rear plate 21 and two identical side members 23, 23' evenly spaced apart over the center axis 16 of the waist support member 12. The rear surface of each side member 23, 23' is securely attached to the front surface 22 of the rear plate 21. The rear plate 21 is centrally aligned and securely attached to the waist support member 12. The side members 23, 23' are parallel and perpendicularly aligned to the front surface 22. Each side member 23, 23' includes a forward and upward extending ear member 24, 24', respectively. Formed near the forward distal tip of each ear member 24, 24' is a first bore 26, 26' which receives a transversely aligned first pin 90. During assembly, the pin 90 extends between the two first bores 26, 26' and through a passageway 62 formed on the hook member 60 to pivotally attach the hook member 60 to the main bracket 20. Formed near the upward tip 27, 27' of each ear member 24, 24' is a second bore 28, 28', respectively, which receives a transversely aligned second pin 92 that extends between the two side members 23, 23' and is used to pivotally connect the lever 45 to the main bracket 20. Formed centrally on each side member 23, 23' is a curved slot 29, 29' which acts as a guide opening for a transversely aligned third pin 94 that extends between the two side members 23, 23' and is used to couple the lower end of the lever 45 and the upper end of the latch 80 together. Also formed centrally on each side member 23, 23' between the first bore 26, 26' and the curved slot 29, 29' is a third bore 30, 30' which is used to hold a transversely aligned stop pin 96 between the side members 23, 23' which is used as a stop surface for the first and second coil springs 33, 36, discussed further below.

The lever 45 includes a narrow, curved upper body 46 with two opposite, downward extending wings 47, 47'. The wings 47, 47' are sufficiently spaced apart to fit closely around the two side members 23, 23' on the main bracket 20. Formed centrally on the wings 47, 47' are bores 48, 48' respectively, designed to receive the second pin 92 to pivotally attach the lever 45 to the main bracket 20. Formed near the lower tip of the wings 47, 47' are bores 49, 49', respectively, designed to receive the third pin 94 that extends through the bore 86 formed on the latch 80.

The hook member 60 includes a forward extending, downward curved arcuate section 65 and a straight rearward extending section 70. Formed on the proximal end 72 of the section 70 is an upward, diagonally aligned tongue member 71. Formed on the lower surface of the tongue member 71 is a recessed curved surface 73 designed to engage the upper edge of the latch 80 discussed further below. Located centrally on the hook member 60 is a transversely aligned bore 62, 62' which receives the first pin 90. When assembled, the hook member 60 is able to rotate 360 degrees around the first pin 90.

The latch 80 is a rectangular-shaped, solid structure that fits inside the center space formed between the two side members 23, 23'. Formed along the lower edge 81 is a longitudinal bore 83 designed to receive the fourth pin 97 to pivotally connect the opposite ends of the latch 80 to the main bracket 20. Formed on the opposite end surface 85 is a second bore 86. The end surface 85 has a slightly curved radius formed thereon which meshes with the recessed curved surface 73 on the hook member 60.

Figure 4:
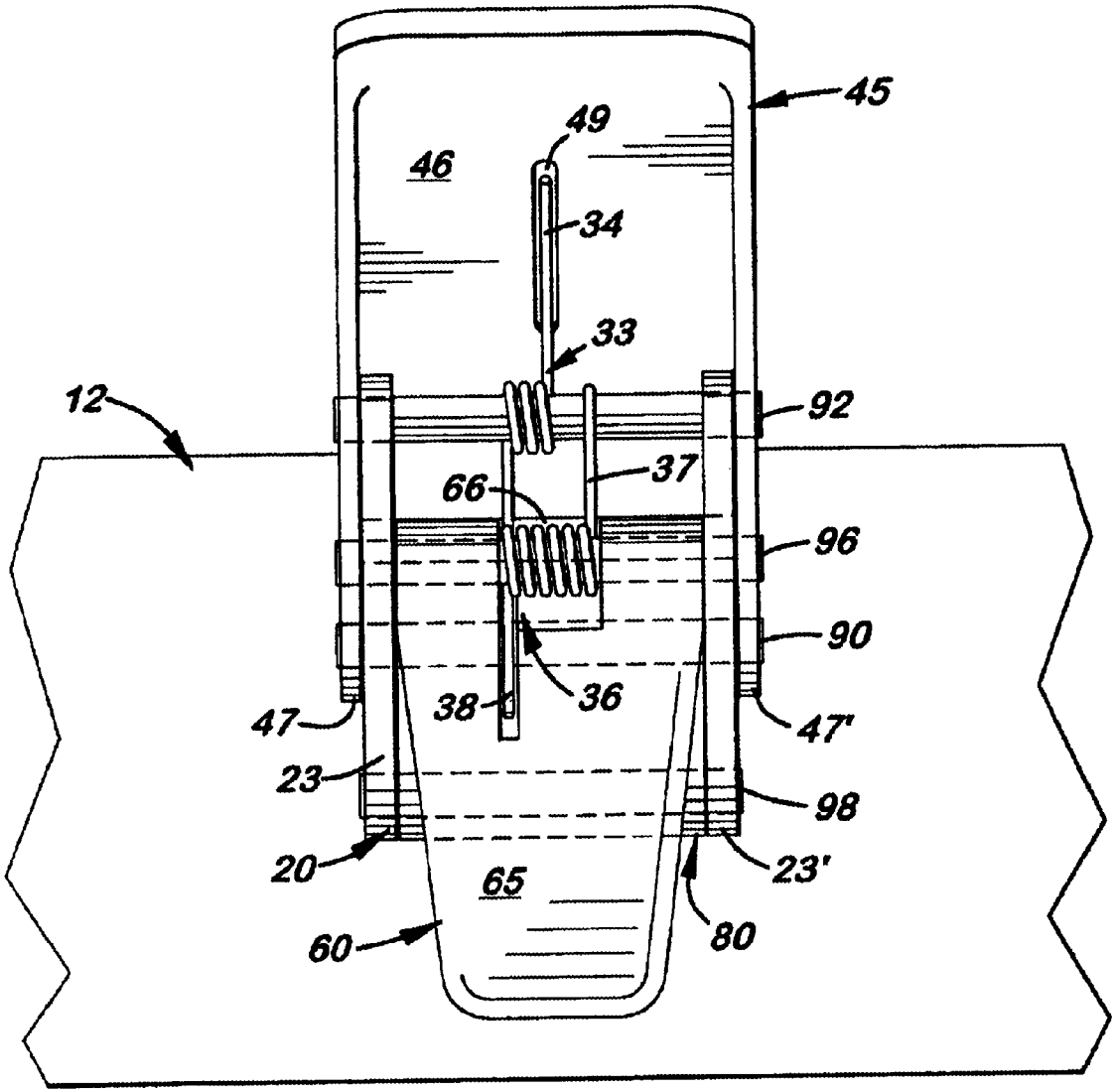
FIG. 4 is a front side elevation view of the invention.
Figure 6:
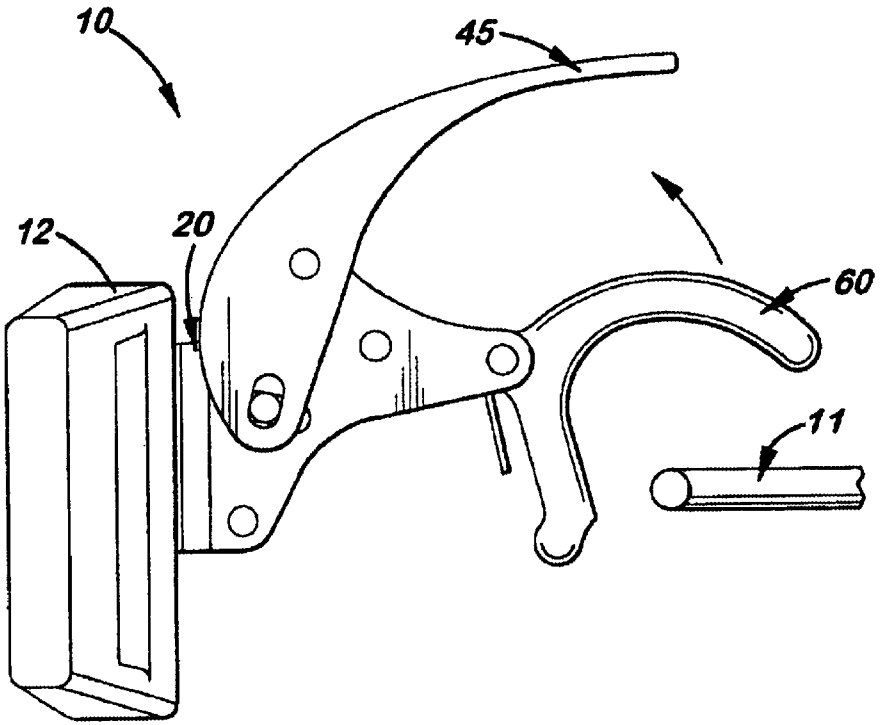
FIG. 6 is a side elevation view of the invention shown in an unlocked position.
Figure 5:
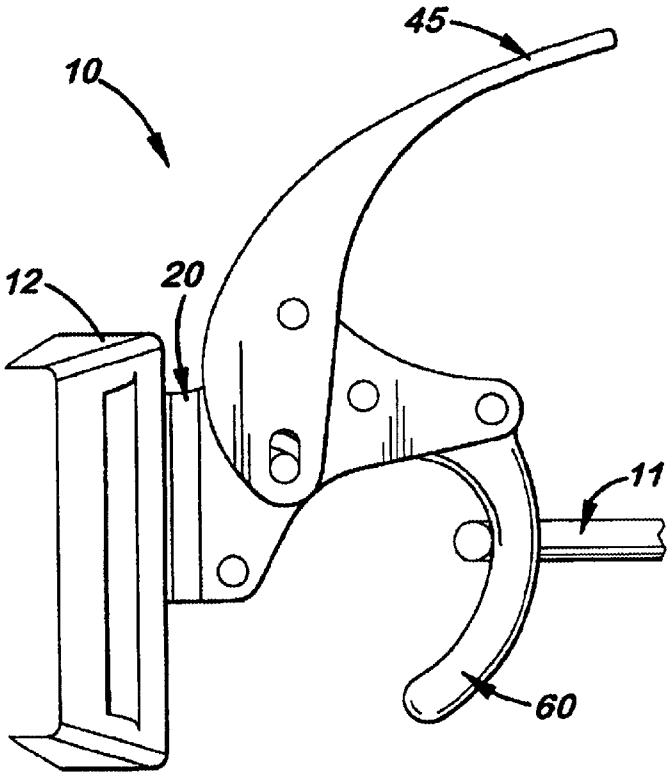
FIG. 5 is a side elevation view of the invention shown in a locked position.
Figure 7:
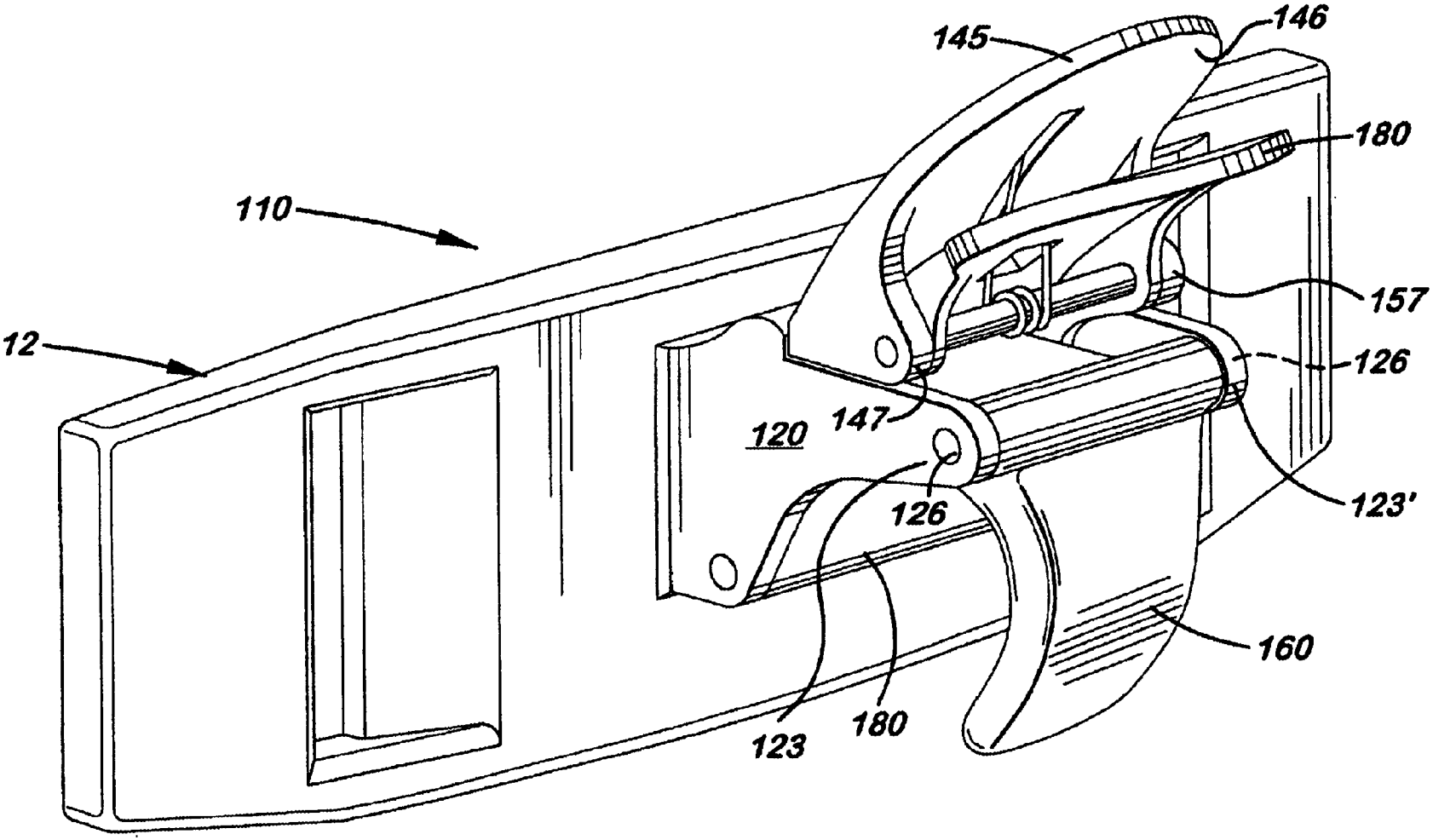
FIG. 7 is a perspective view of a second embodiment of the quick release device used by kite surfers.
Figure 8:
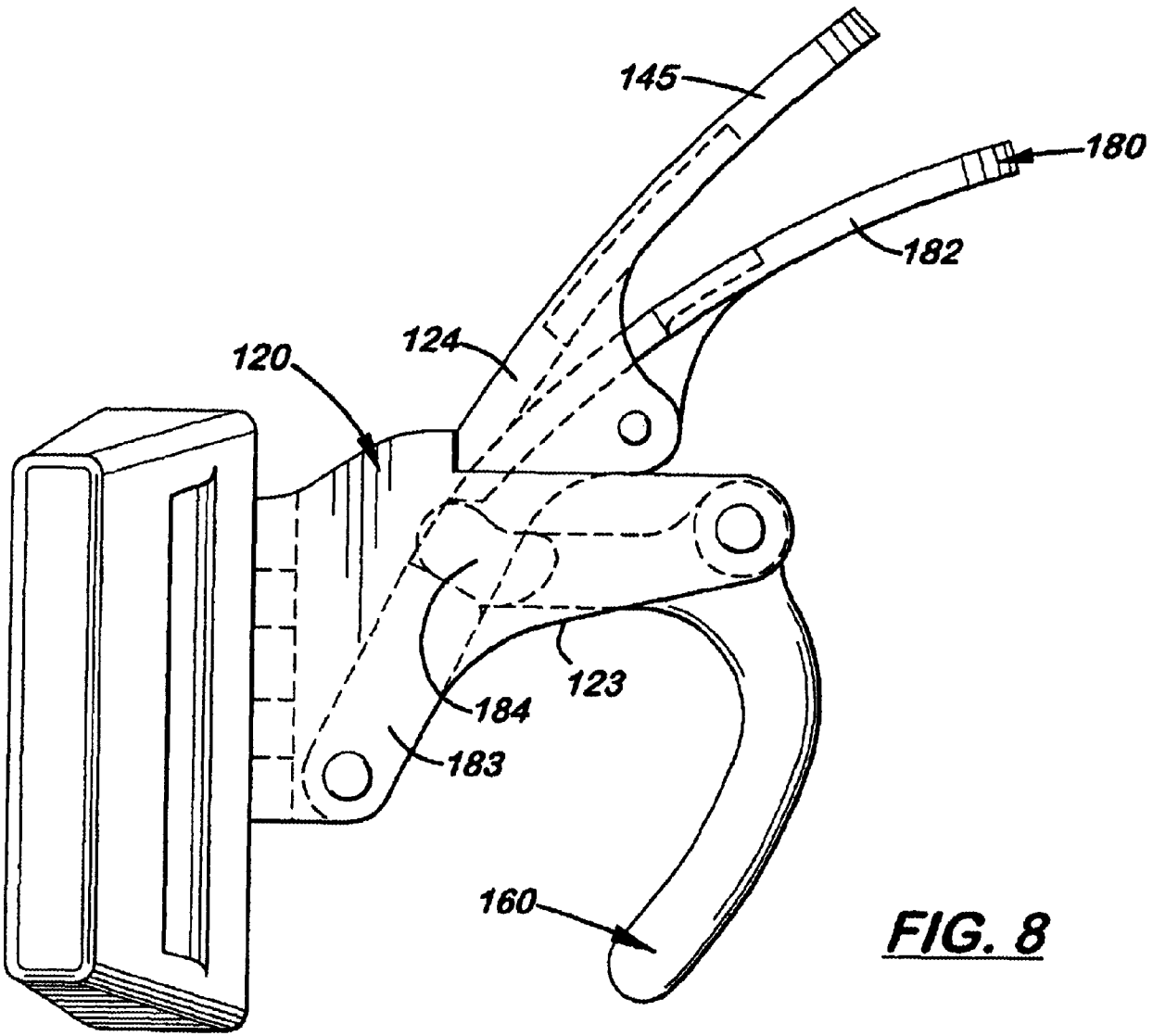
FIG. 8 is a side elevational view of the device shown in FIG. 7.
Figure 9:
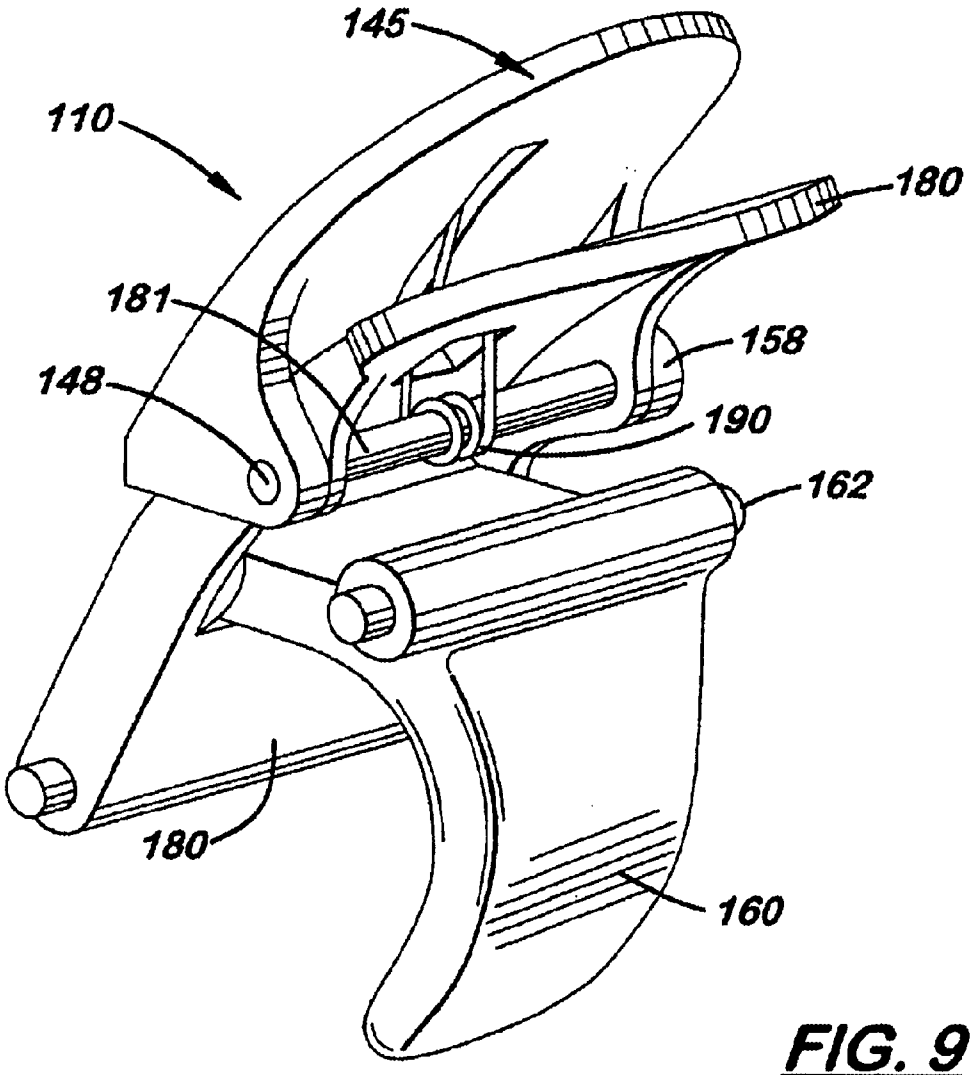
FIG. 9 is a perspective view of the second embodiment of the device shown in FIGS. 7 and 8 with the main bracket removed.
Figure 11:
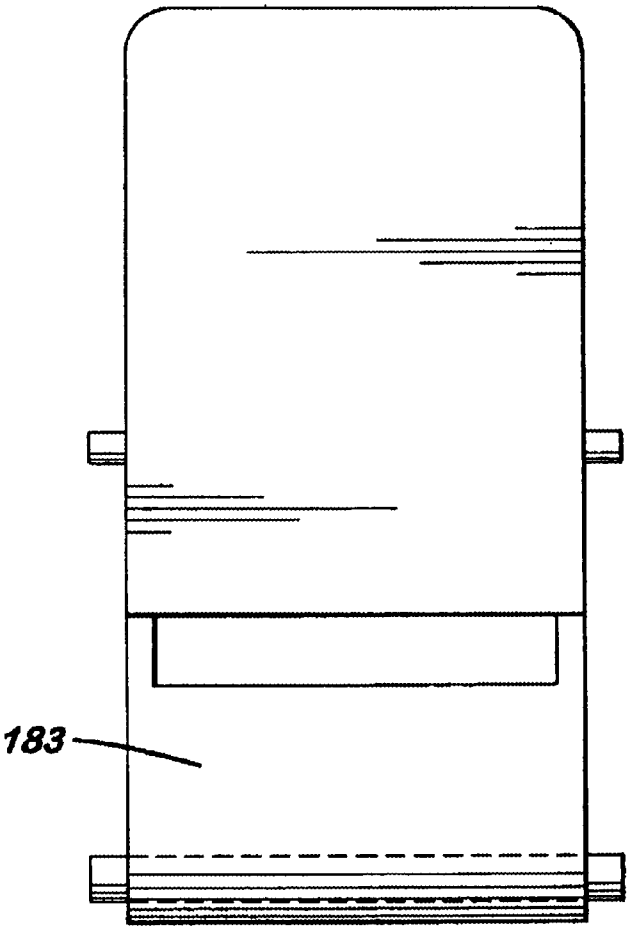
FIG. 11 is a rear elevational view of the latch used on the second embodiment.
Figure 10:
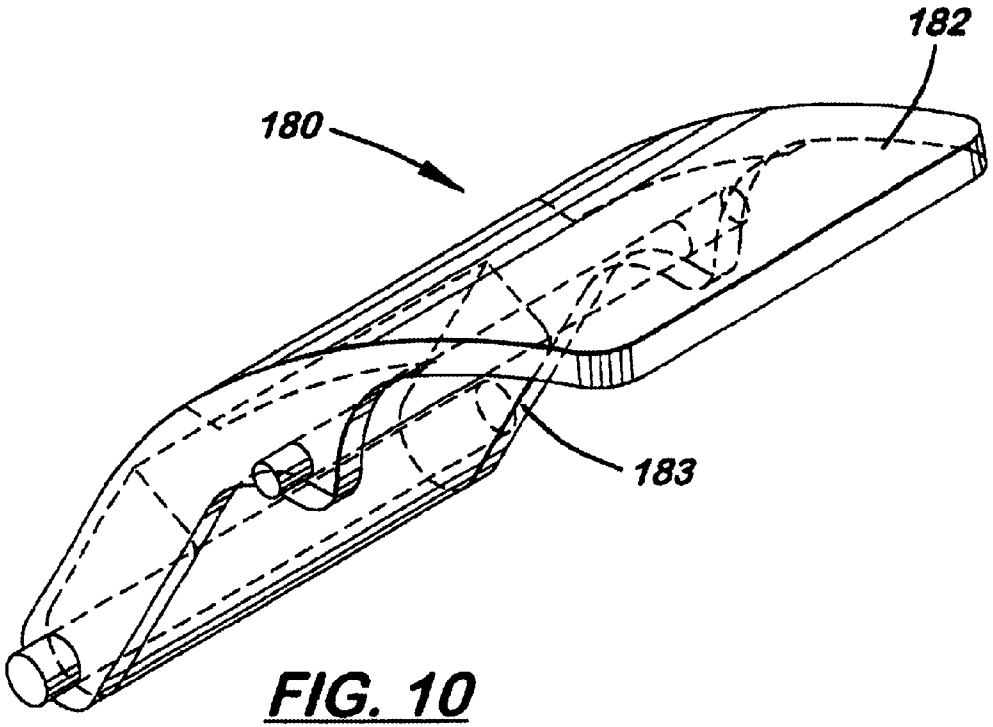
FIG. 10 is a perspective view of the latch used on the second embodiment.

A first biasing means is disposed between the lever 45 and the main bracket 20 which is used to bias the lever 45 in an upward extended position and automatically return the lever 45 to this position when released. In the preferred embodiment, the first biasing means includes a first coil spring 33 disposed around the second pin 92. The legs 34, 35 on the coil spring 33 are sufficient in length to press against the inside surface of the lever 45 and stop pin 96, respectively, when assembled. An optional recessed surface on the upper body 46 (shown more clearly in FIG. 4) may be formed on the bottom surface of the lever 45 to receive leg 34.

A second biasing means is disposed between the hook member 60 and the main bracket 20 to maintain the hook member 60 in an opened, downward extending position. In the preferred embodiment, the second biasing means is a coil spring 36 disposed around the first pin 90. One leg 37 of the coil spring 36 extends over the stop pin 96 while the opposite leg 38 extends downward and presses against the top surface of the hook member 60. In the preferred embodiment, an elongated opening 66 is formed in the hook member 60 in which the coil spring 36 may be disposed around the first pin 90. Formed on the outer surface of the arcuate section 65 is a slot 67 designed to receive the lower leg 38 of the second coil spring 36.

As shown more clearly in FIG. 3, a third biasing means is disposed between the latch 80 and the main bracket 20 and is used to automatically force the latch 80 forward to engage the proximal end 72 of the hook member 60. In the preferred embodiment, the third biasing means includes a coil spring 40 disposed around a pin 97. One leg 41 of the coil spring 40 is placed along the front surface of the main bracket 20 while the second leg 42 is positioned against the inside surface of the latch 80.

During assembly, the lever 45 is pivotally attached to the main bracket 20 via the second pin 92. The hook member 60 is pivotally attached to the main bracket 20 via the first pin 90 and the lower lip of the latch 80 is attached to the main bracket 20 by the fourth pin 97. Stop pin 96 is then extended throughout bore 49, slot 29, bore 62, slot 29', and bore 49' to couple the lever 45, hook member 60 and latch 80 together. The coil springs 33, 36 and 40 are properly positioned around pins 92, 90 and 97, respectively, to hold the lever 45 in an upward extended position, to force the latch 80' forward and to force the arcuate section 65 of the hook member 60 downward. When the lever 45 is pressed downward, the upper edge of the latch 80 is forced inward and the proximal end 72 of the hook member 60 disengages from the end 82 of the latch 80. The proximal end 72 of the hook member 60 is able to rotate counterclockwise and disengage from a ring 11 attached to a harness line 98.

The coil spring 40 disposed around the fourth pin 97 automatically returns the latch 80 to a locked position when the hook member 60 is released. The second coil spring 36 applies a tension force on the lever 45 and the hook member 60 so that they automatically return to their original positions for reengagement to the ring 11.

FIGS. 7–10 show a second embodiment of the quick release harness device, designated 110, designed to be used by kite surfers that operates in a similar manner. In the preferred embodiment, the device 110 includes a main bracket 120, a lever 145, a hook member 160 and a latch 180. The main bracket 120 attaches to a waist support member 12 worn around the waist of a user. The main bracket 120 is nearly identical to the main bracket 20 discussed above, except that it includes a horizontally aligned cutout surface 124 formed on the top surface of each side member 123, 123'. The main bracket 120 also does not include a bore similar to the first bore 26 used on the side member 23, 23' on the main bracket 20.

The lever 145 includes a main body 146 with two parallel side wings 147, 157. Bores 148, 158 are formed in the wings 147, 157 that receive the ends of a pin 181 transversely connected to the upper section of the latch 180.

The hook member 160 is nearly identical to hook member 60 used with the device 10. Attached to the hook member 160 is a transversely aligned pin 162 used to pivotally attach the hook member 160 to the bores 126 formed on the main bracket 120.

The latch 180 includes an upper curved portion 182 and a lower straight portion 183. The lower straight section 183 includes a fixed, beveled support member 184 that acts as a support surface for the hook member 160.

During use, the latch 180 moves between locked and unlocked positions by manually pressing downward on the lever 145 which disengages the lever 145 from the main bracket 120 and allows the surfer to pull the lever 145 rearward. Since the lever 145 is pivotally attached to the upper curved portion 182 of the latch 180 that extends upward and above the hook member 160, the latch 180 automatically pivots rearward thereby moving the beveled support member 184 away from the hook member 160. The hook member 160 is now able to rotate counterclockwise. A first coil spring 190 is disposed between the lever 145 and the upper curved portion 182 of the latch member 180 to maintain the lever 145 in a locked position on the main bracket 120. A second coil spring 192 is disposed between the latch 180 and the main bracket 120 to keep the latch 180 in a locked position.

The functional difference between device 10 and device 110 is that the surfer is required to press downward and pull the lever 145 rearward to disengage the hook member 160 from the ring 11 rather than only press the lever 45 downward. By requiring two motions rather than one motion, inadvertent disconnection from the ring 11 is prevented while kite surfing.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A quick release harness system, comprising:

a. a waist support member;

b. a main bracket attached to said waist support member, said bracket including two parallel and spaced apart arms substantially perpendicularly aligned with said waist support member, each said arm including an upward extending curved slot located directly across from each other;

c. a lever pivotally attached to said main bracket, said lever including an upper section that curves upward and outward from said main bracket, a lower section that extends downward and adjacent to said arms on said main bracket, and a pair of side arms each including an elongated bore formed thereon;

d. a hook member pivotally attached to said main bracket and below said lever, said hook member including a forward and downward curved arcuate section and a rearward extending section;

e. a first biasing member disposed between said hook member and said main bracket used to maintain said hook member in an upward extending position;

f. an actuator latch pivotally attached at one end to said main bracket, said latch including an upper support surface that supports said rearward extending section of said hook member, said latch including a pin that extends from the sides of said latch to engage said curved slots on said arms on said main bracket;

g. a second biasing means disposed between said hook member and said bracket to keep said hook member engaged on said support surface on said latch;

h. a third biasing means disposed between said latch and said main bracket to keep said latch and said main bracket in a forward extended position to support said rear extending section of said hook member;

i. said actuator pin transversely aligned between said arms of said main bracket and extending through said curved slots formed on said arms on said main bracket and said elongated slots formed on said side arms on said lever; and, j. wherein when said force is applied to said hook element, said latch automatically moves to a locked position and said lever moves to an upward extended position and when a downward force is selectively applied to said lever, said latch automatically disengages thereby allowing the latch to rotate upward and disengage from a pull cord.

* * * * *